US009921016B1

(12) United States Patent
Couie

(10) Patent No.: US 9,921,016 B1
(45) Date of Patent: Mar. 20, 2018

(54) FIREARM MAGAZINE UNLOADER

(71) Applicant: William Christopher Couie, Vidalia, LA (US)

(72) Inventor: William Christopher Couie, Vidalia, LA (US)

( * ) Notice: Subject to any disclaimer, the term of this patent is extended or adjusted under 35 U.S.C. 154(b) by 0 days.

(21) Appl. No.: 15/487,238

(22) Filed: Apr. 13, 2017

Related U.S. Application Data

(63) Continuation-in-part of application No. 15/440,984, filed on Feb. 23, 2017.

(60) Provisional application No. 62/445,058, filed on Jan. 11, 2017, provisional application No. 62/396,643, filed on Sep. 19, 2016.

(51) Int. Cl.
*F41A 9/83* (2006.01)
*F41A 9/67* (2006.01)

(52) U.S. Cl.
CPC . *F41A 9/83* (2013.01); *F41A 9/67* (2013.01)

(58) Field of Classification Search
CPC ..... F41A 9/83; F41A 9/84; F41A 9/66; F41A 9/67
USPC ..... 42/87
See application file for complete search history.

(56) References Cited

U.S. PATENT DOCUMENTS

| | | | | |
|---|---|---|---|---|
| 4,538,371 | A | 9/1985 | Howard | |
| 4,570,371 | A | 2/1986 | Mears | |
| 4,993,180 | A * | 2/1991 | Upchurch | F41A 9/83 42/87 |
| 6,810,616 | B2 * | 11/2004 | Tal | F41A 9/83 42/87 |
| 6,817,134 | B2 | 11/2004 | Newman | |
| 7,257,919 | B1 | 8/2007 | Farley | |
| 8,453,366 | B2 | 6/2013 | Gray | |
| 9,335,108 | B2 | 5/2016 | Cauley et al. | |
| 9,404,697 | B2 | 8/2016 | Cobb | |
| 2004/0020096 | A1 | 2/2004 | Tal et al. | |
| 2013/0192117 | A1 | 8/2013 | Meinel | |
| 2013/0232843 | A1 * | 9/2013 | Bajuelo | F41A 9/83 42/87 |
| 2014/0298704 | A1 | 10/2014 | Niccum | |

* cited by examiner

*Primary Examiner* — Stephen Johnson
(74) *Attorney, Agent, or Firm* — IDP Patent Services; Olav M. Underdal

(57) ABSTRACT

A firearm magazine unloader includes an unloader housing, including right and left sides, and a bridge member; an unloading protrusion; and right, left and top flange grips. The magazine unloader can be plastic molded in one piece. Also disclosed is a method of using the magazine unloader, including positioning unloader and unloading a firearm round.

16 Claims, 8 Drawing Sheets

Magazine Unloader

Method of using the magazine loader/unloader

FIREARM MAGAZINE UNLOADER

CROSS-REFERENCE TO RELATED APPLICATIONS

This application is a continuation-in-part of U.S. Non-Provisional application Ser. No. 15/440,984, filed Feb. 23, 2017, which claims the benefit of U.S. Provisional Application No. 62/445,058, filed Jan. 11, 2017 and of U.S. Provisional Application No. 62/396,643, filed Sep. 19, 2016.

FIELD OF THE INVENTION

The present invention relates generally to the field of firearm magazines, and more particularly to devices, methods and systems for unloading a firearm magazine.

BACKGROUND OF THE INVENTION

Use of semi-automatic firearms require tedious and time consuming unloading of magazines. Unloading devices are available, but are generally complicated devices, which may be difficult in use and expensive to manufacture.

As such, considering the foregoing, it may be appreciated that there continues to be a need for novel and improved devices and methods for unloading a firearm magazine.

SUMMARY OF THE INVENTION

The foregoing needs are met, to a great extent, by the present invention, wherein in aspects of this invention, enhancements are provided to the existing model of loading and unloading a firearm magazine.

In an aspect, a firearm magazine unloader, can include:

a) an unloader housing, including:
   right and left sides, which are parallel;
   such that the unloader housing defines a housing interior that can accept an upper end of a firearm magazine;

b) an unloading protrusion, which protrudes downward in a rear of the unloader housing;

such that, when the unloading structure is placed on the upper end of the firearm magazine with the right and left sides on right and left sides of the of the firearm magazine, such that the unloading protrusion is positioned against a rear of the firearm magazine and the magazine unloader is pushed forward, the unloading protrusion engages with a rear end of an ammunition round and moves the ammunition round forward, such that the ammunition round is ejected from the firearm magazine.

In a related aspect, the magazine unloader can further include:

a bridge member, which connects between top parts of the right and left sides.

such that the unloading protrusion protrudes downward from the bridge member.

In a related aspect, the magazine unloader can further include right, left, and/or top flange grips, which provide additional grip for a hand of a user holding the magazine unloader during use.

In another aspect, a method of using the magazine unloader can include:

a) Positioning unloader, wherein the magazine unloader is placed on the upper end of the firearm magazine, such that the unloading protrusion is positioned against a rear of the firearm magazine;

b) Unloading round, wherein the magazine unloader is pushed forward, such that the unloading protrusion engages with a rear end of the ammunition round and moves the ammunition round forward, and thereby ejects the ammunition round from the firearm magazine.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
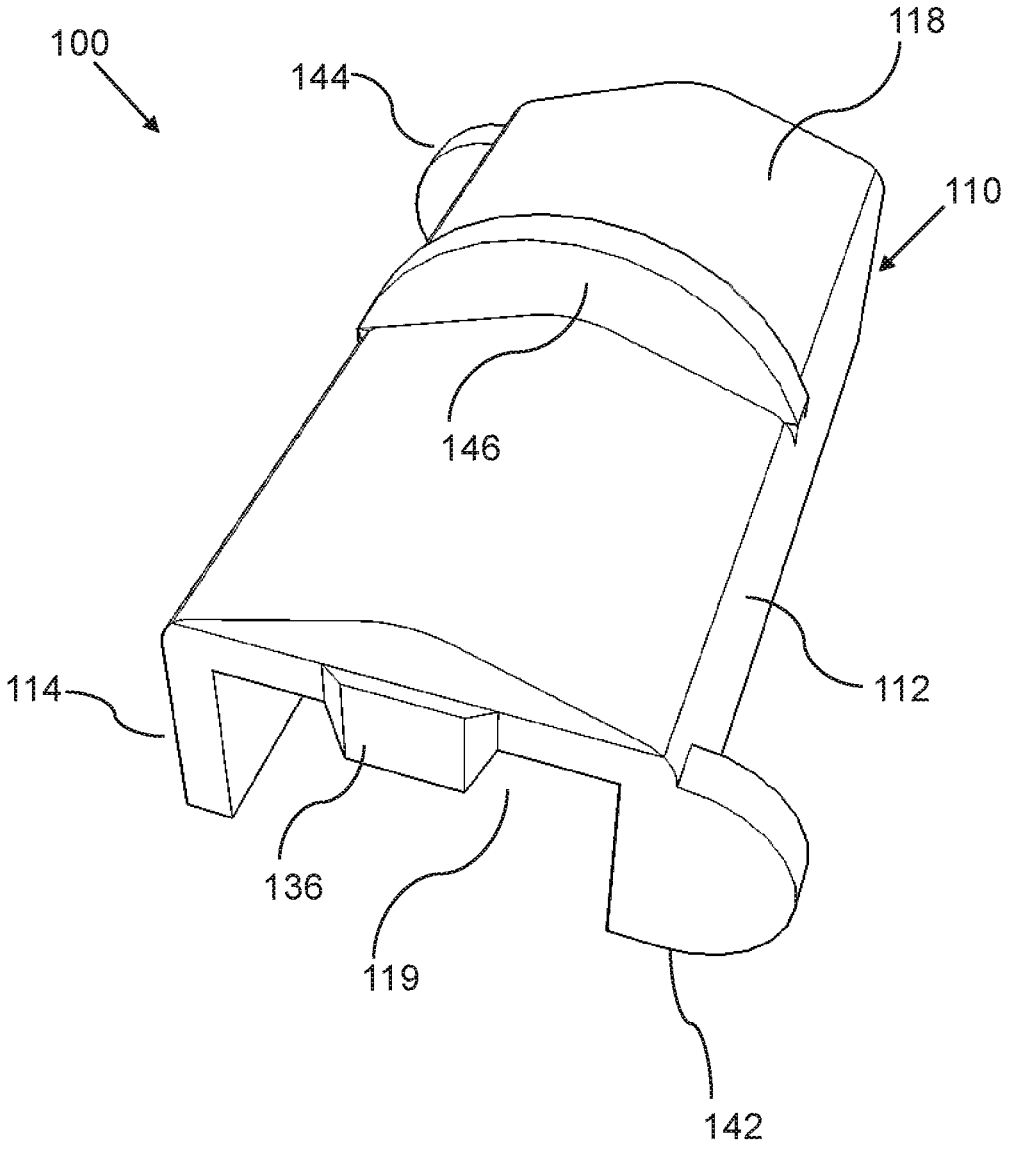
FIG. 1 is a rear perspective view of a magazine unloader, according to an embodiment of the invention.
Figure 2:
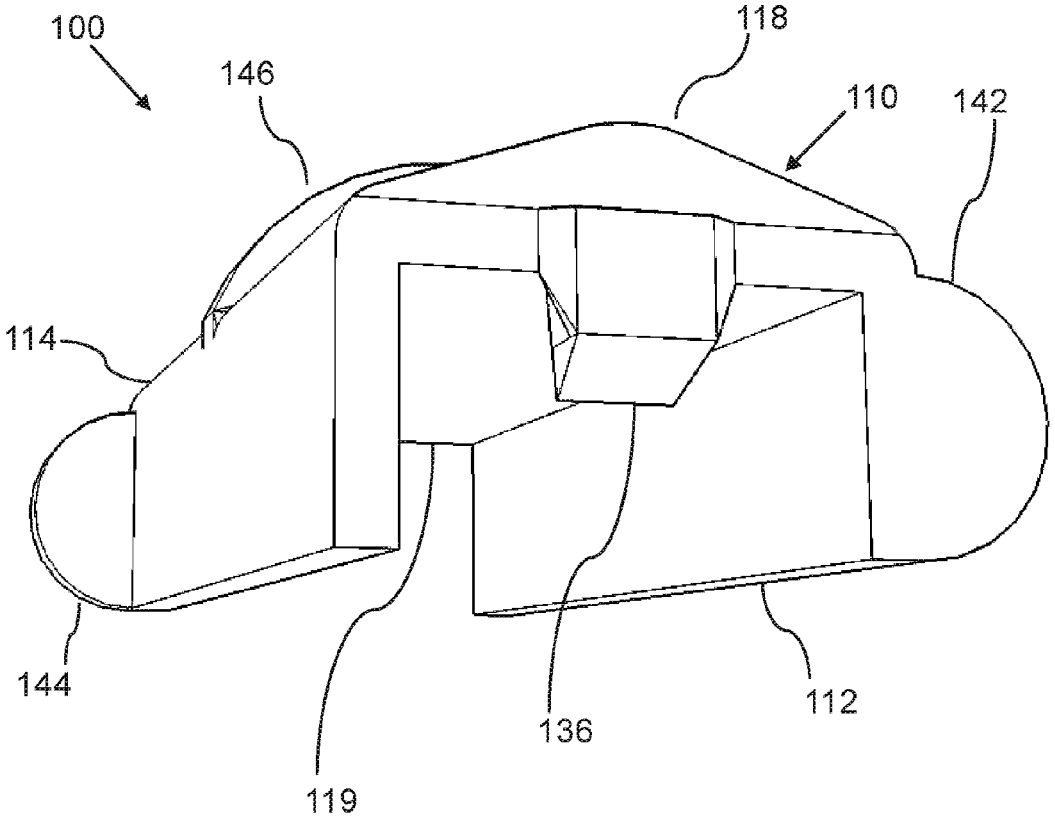
FIG. 2 is a rear bottom perspective view of a magazine unloader, according to an embodiment of the invention.
Figure 3:
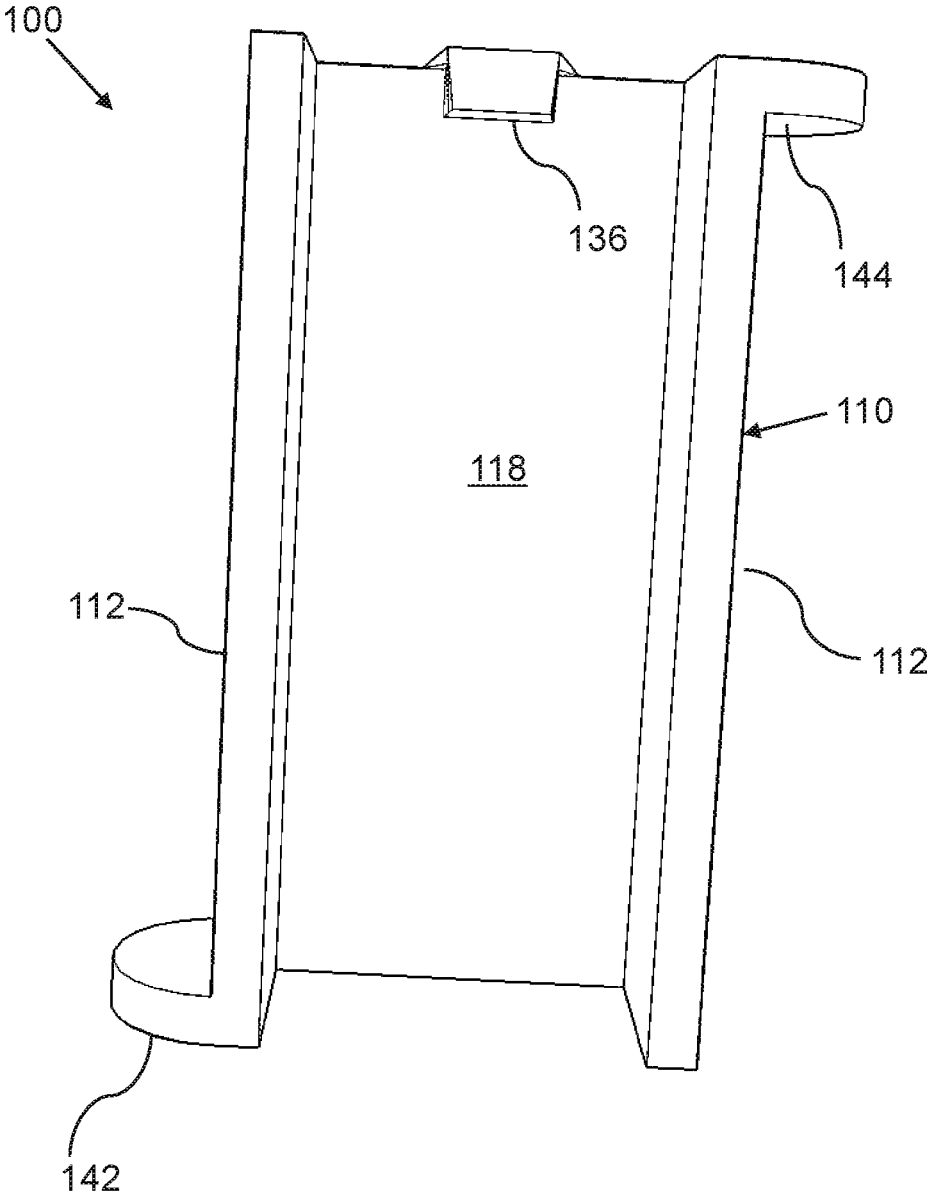
FIG. 3 is a bottom perspective view of a magazine unloader, according to an embodiment of the invention.
Figure 4:
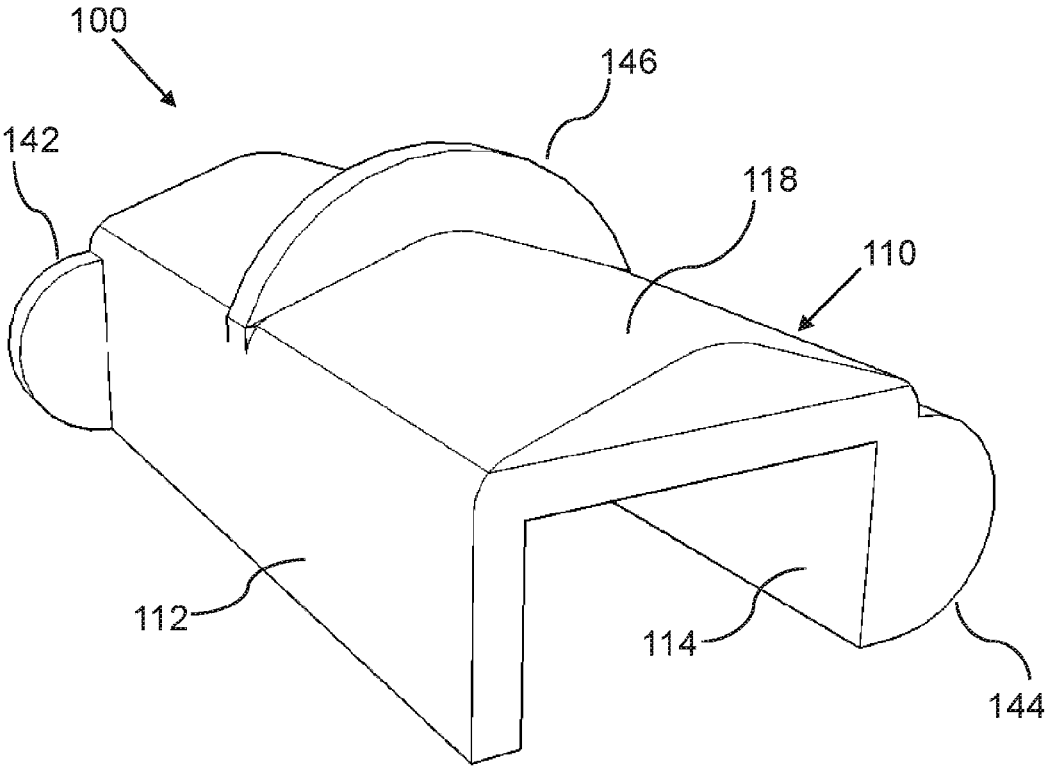
FIG. 4 is a front side perspective view of a magazine unloader, according to an embodiment of the invention.

In the following, we describe the structure of an embodiment of a magazine unloader 100 with reference to FIG. 1, in such manner that like reference numerals refer to like components throughout; a convention that we shall employ for the remainder of this specification.

Figure 5A:
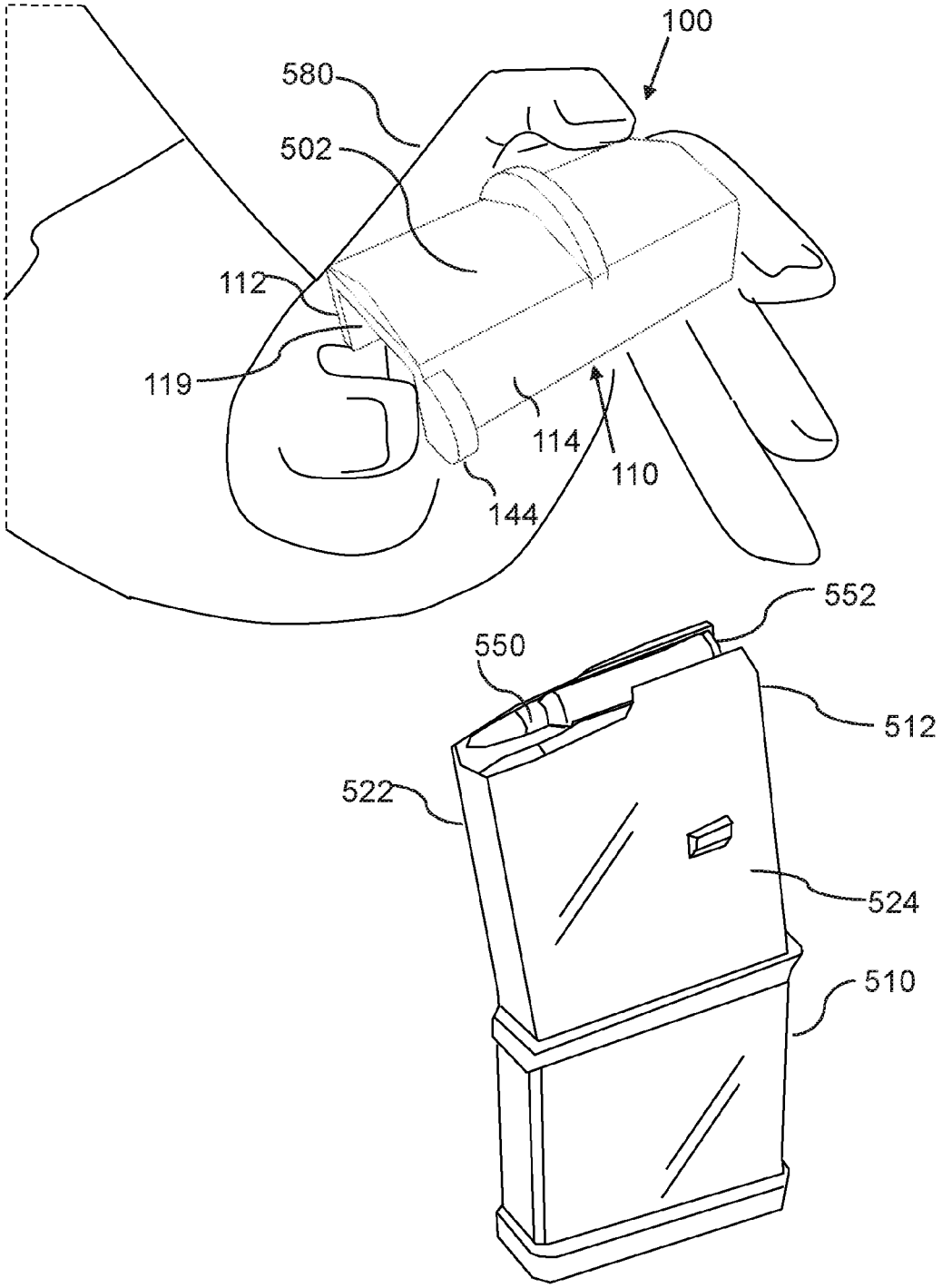
FIG. 5A is a perspective view of a magazine unloader in use for unloading a magazine, according to an embodiment of the invention.
Figure 5B:
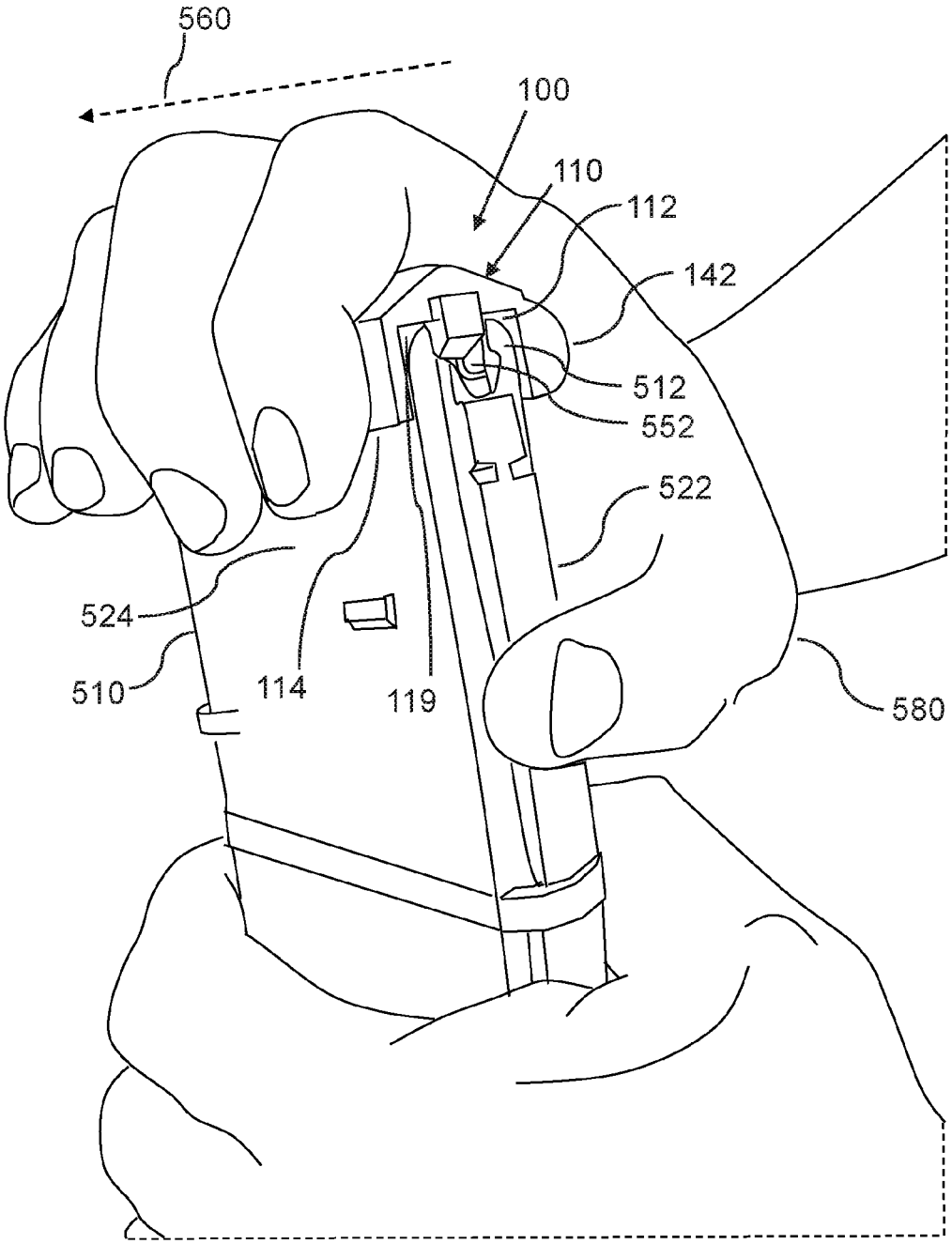
FIG. 5B is a perspective view of a magazine unloader in use for unloading a magazine, according to an embodiment of the invention.

In an embodiment, as shown in FIGS. 1-4, a magazine unloader 100 can include:

a) An unloader housing 110, including:
   i. right and left sides 112 114;
   ii. a bridge member 118, which connects between top parts of the right and left sides 112 114;
   such that the unloader housing 110 is elongated with a u-shaped cross-section;
   such that the right and left sides 112 114 are parallel;
   such that the unloader housing 110 defines a housing interior 119 between the right and left sides 112 114;
   such that the unloader housing 110, as shown in FIGS. 5A and 5B, is configured to accept an upper end 512 of a firearm magazine 510, via insertion of the firearm magazine 510 into the housing interior 119;

b) an unloading protrusion 136, which is mounted in a rear of the unloader housing 110, between rear ends of the right and left sides 112 114, for example such that the unloading protrusion 136 can be connected to a rear center part of the bridge member 118, such that the unloading protrusion protrudes downward from the bridge member 118;

c) a right flange grip 142, which can be mounted on an outer side of a rear end of the right side 112, such that the right flange grip 142 protrudes rightwards, substantially perpendicularly to the right side 112;

d) a left flange grip 144, which can be mounted on an outer side of a front end of the left side 113, such that the left flange grip 144 protrudes leftwards, substantially perpendicularly from the left side 114;

e) a top flange grip 146, which can be mounted on a top of the bridge member 118, such that the top flange grip 146 protrudes upwards, substantially perpendicularly to the top side 114;

wherein, as shown in FIGS. 5A and 5B, when the unloading structure 130 is placed on the upper end 512 of the firearm magazine 510 with the right and left sides 112 114 on respectively right and left sides 522 524 of the of the firearm magazine 510, such that the unloading protrusion 136 is positioned against a rear of the firearm magazine 510 and the magazine unloader 100 is pushed forward 560: the unloading protrusion 136 engages with a rear end 552 of the ammunition round 550 and moves the ammunition round 550 forward, such that the ammunition round 550 is ejected from the firearm magazine 510;

wherein right, left, and top flange grips 142 144 146 provide additional grip for a hand 580 of a user holding the magazine unloader 100 during use.

In a related embodiment, the magazine unloader 100 can be manufactured as one piece, for example by injection molding or by additive manufacturing, such as fused deposition modeling. Alternatively, the magazine unloader 100 can be assembled from separate pieces that are for example glued or fused together. The magazine loader can be made of a plastic material, or other suitable materials, such as metal, including rubber or plastic coated metal.

Figure 6:
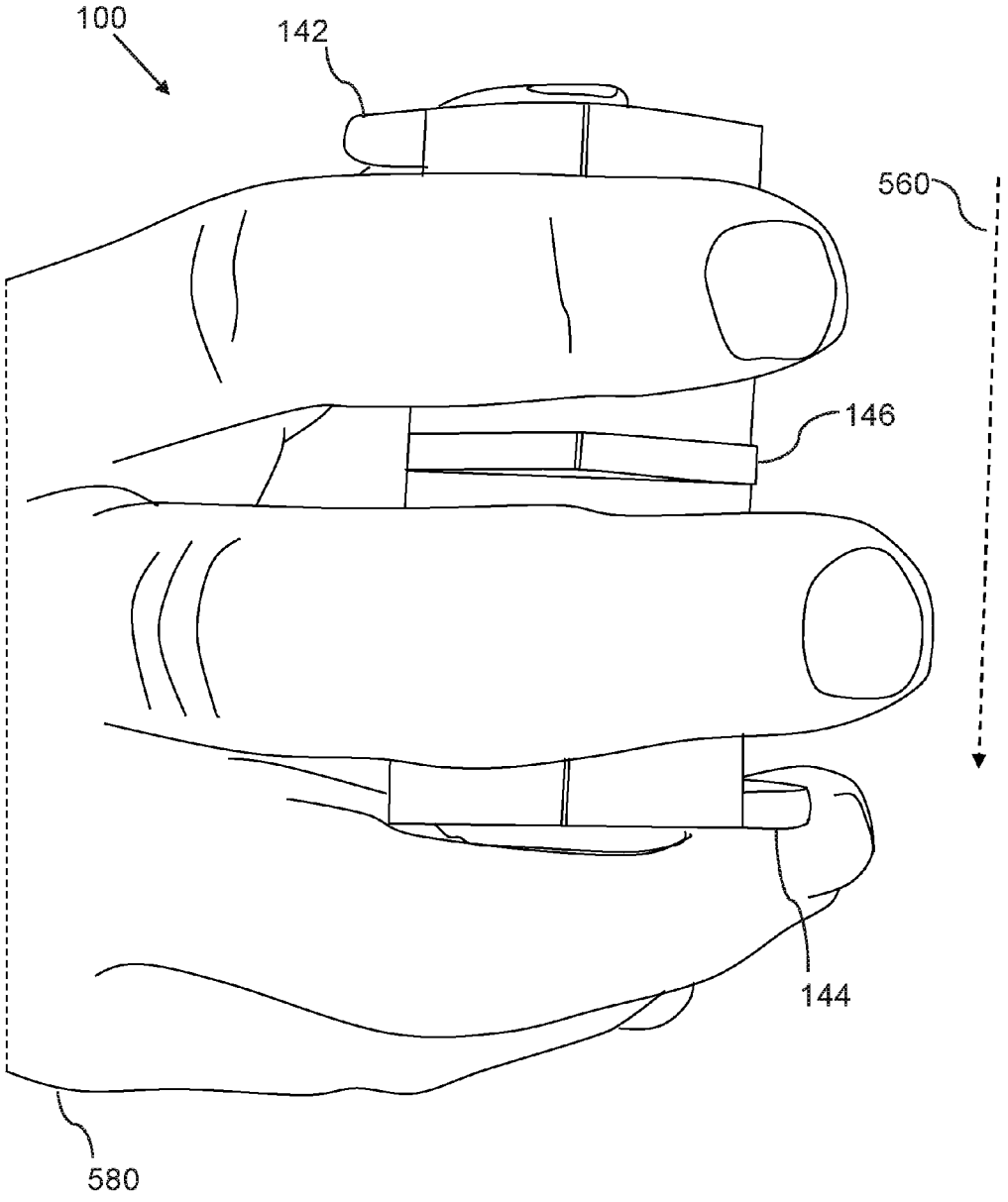
FIG. 6 is a perspective view of a magazine unloader in use for unloading a magazine, according to an embodiment of the invention.
Figure 7:
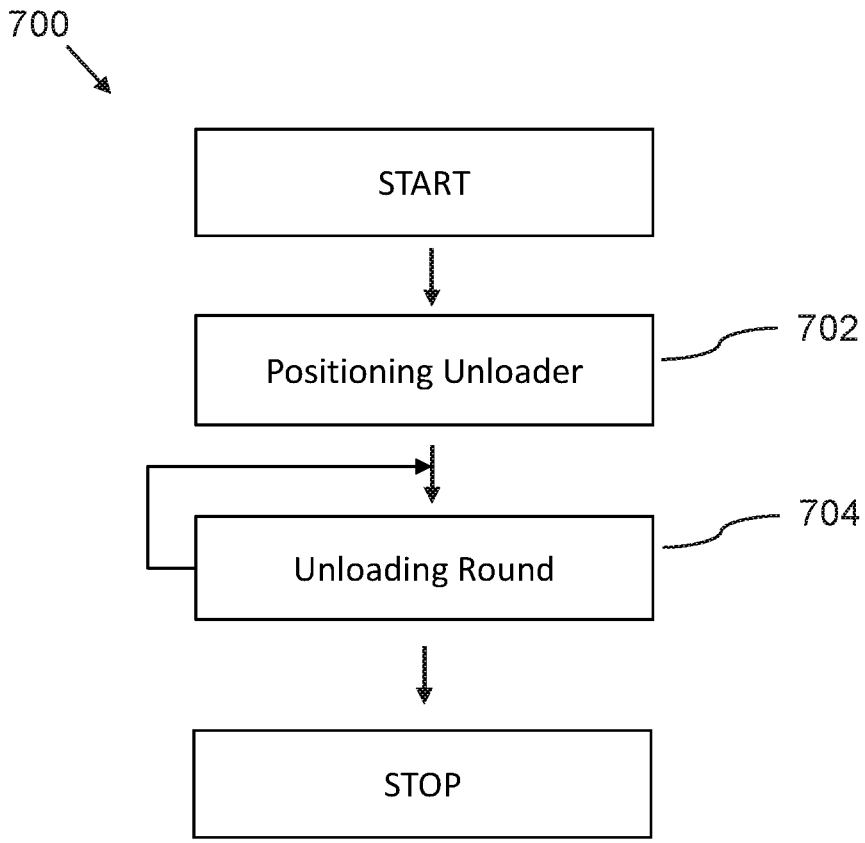
FIG. 7 is a flowchart illustrating steps that may be followed, in accordance with one embodiment of a method or process of using a magazine unloader.

In an embodiment, a method of using the magazine unloader 700 can include:

a) Positioning unloader 702, wherein the magazine unloader 100 is placed on the upper end 512 of the firearm magazine 510 with the right and left sides 112 114 on respectively right and left sides 522 524 of the of the firearm magazine 510, such that the unloading protrusion 136 is positioned against a rear of the firearm magazine 510;

b) Unloading round 704, wherein the magazine unloader 100 is pushed forward 560, as shown in FIGS. 5B and 6, such that the unloading protrusion 136 engages with a rear end of the ammunition round 550 and moves the ammunition round 550 forward, such that the ammunition round 550 is ejected from the firearm magazine 510;
   wherein the right and left sides 112 114 are parallel;
   wherein the right and left sides 112 114 ensure a smooth forward sliding motion and ensures positioning of the unloading protrusion 136, such that the unloading protrusion 136 engages the ammunition round 550;
   wherein the firearm magazine 510 can be emptied by sliding the magazine unloader 100 back to the original position and repeating unload round 704 until the firearm magazine 510 is unloaded to a desired level, such as for example completely unloaded.

Here has thus been described a multitude of embodiments of the magazine unloader 100 and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A magazine unloader, comprising:

a) an unloader housing, comprising:
   right and left sides, which are parallel;
   such that the unloader housing defines a housing interior between the right and left sides;
   such that the unloader housing, is configured to accept an upper end of a firearm magazine, via insertion of the firearm magazine into the housing interior; and b) an unloading protrusion, which is mounted in a rear of the unloader housing, between rear ends of the right and left sides, such that the unloading protrusion protrudes downward;

wherein, when the unloading protrusion is placed on the upper end of the firearm magazine with the right and left sides on respectively right and left sides of the of the firearm magazine, such that the unloading protrusion is positioned adjacent a rear of the firearm magazine and the magazine unloader is pushed forward, the unloading protrusion is configured to engage with a rear end of an ammunition round and move the ammunition round forward, such that the ammunition round is ejected from the firearm magazine.

2. The magazine unloader of claim 1, wherein the unloader housing further comprises:

a bridge member, which connects between top parts of the right and left sides;

such that the unloading protrusion is connected to a rear center part of the bridge member, such that the unloading protrusion protrudes downward from the bridge member.

3. The magazine unloader of claim 1, further comprising:

a right flange grip, which is connected to an outer side of a rear end of the right side, such that the right flange grip protrudes rightward from the right side.

4. The magazine unloader of claim 1, further comprising:

a left flange grip, which is connected to an outer side of a front end of the left side, such that the left flange grip protrudes leftward from the left side.

5. The magazine unloader of claim 2, further comprising:

a top flange grip, which is connected to a top side of the bridge member, such that the top flange grip protrudes upward, substantially perpendicular to the top side.

6. The magazine unloader of claim 2, further comprising:

a) a right flange grip, which is connected to an outer side of a rear end of the right side, such that the right flange grip protrudes rightward from the right side;

b) a left flange grip, which is connected to an outer side of a front end of the left side, such that the left flange grip protrudes leftward from the left side; and c) a top flange grip, which is connected to a side top of the bridge member, such that the top flange grip protrudes upward, substantially perpendicular to the top side;

whereby the right, left, and top flange grips provide additional grip for a hand of a user holding the magazine unloader during use.

7. The magazine unloader of claim 1, wherein the magazine unloader is manufactured in one piece.

8. The magazine unloader of claim 1, wherein the magazine unloader is manufactured of a plastic material.

9. A method of using a magazine unloader, comprising:

a) positioning the unloader, wherein the magazine unloader is placed on an upper end of a firearm magazine with right and left sides of the magazine loader on respectively right and left sides of the of the firearm magazine, such that an unloading protrusion of the magazine unloader is positioned adjacent a rear of the firearm magazine; and b) unloading an ammunition round, wherein the magazine unloader is pushed forward, such that the unloading protrusion engages with a rear end of the ammunition round and moves the ammunition round forward, such that the ammunition round is ejected from the firearm magazine;

wherein the magazine unloader comprises:

an unloader housing, comprising:

the right and left sides, which are parallel;

such that the unloader housing defines a housing interior between the right and left sides;

such that the unloader housing, is configured to accept the upper end of the firearm magazine, via insertion of the firearm magazine into the housing interior; and the unloading protrusion, which is mounted in a rear of the unloader housing, between rear ends of the right and left sides, such that the unloading protrusion protrudes downward.

10. The method of using a magazine unloader of claim 9, wherein the unloader housing further comprises:

a bridge member, which connects between top parts of the right and left sides;

such that the unloading protrusion is connected to a rear center part of the bridge member, such that the unloading protrusion protrudes downward from the bridge member.

11. The method of using a magazine unloader of claim 9, wherein the magazine unloader further comprises:

a right flange grip, which is connected to an outer side of a rear end of the right side, such that the right flange grip protrudes rightward from the right side.

12. The method of using a magazine unloader of claim 9, wherein the magazine unloader further comprises:

a left flange grip, which is connected to an outer side of a front end of the left side, such that the left flange grip protrudes leftward from the left side.

13. The method of using a magazine unloader of claim 10, wherein the magazine unloader further comprises:

a top flange grip, which is connected to a top side of the bridge member, such that the top flange grip protrudes upward, substantially perpendicular to the top side.

14. The method of using a magazine unloader of claim 10, wherein the magazine unloader further comprises:

a right flange grip, which is connected to an outer side of a rear end of the right side, such that the right flange grip protrudes rightward from the right side;

a left flange grip, which is connected to an outer side of a front end of the left side, such that the left flange grip protrudes leftward from the left side; and a top flange grip, which is connected to a top side of the bridge member, such that the top flange grip protrudes upward, substantially perpendicular to the top side;

whereby the right, left, and top flange grips provide additional grip for a hand of a user holding the magazine unloader during use.

15. The method of using a magazine unloader of claim 9, wherein the magazine unloader is manufactured in one piece.

16. The method of using a magazine unloader of claim 9, wherein the magazine unloader is manufactured of a plastic material.

* * * * *